United States Patent [19]

Ellingson

[11] Patent Number: 4,720,936

[45] Date of Patent: Jan. 26, 1988

[54] EXTRUDED WEATHER STRIP STRUCTURE

[75] Inventor: Robert T. Ellingson, Covington, Ga.

[73] Assignee: Astro Plastics, Covington, Ga.

[21] Appl. No.: 928,181

[22] Filed: Nov. 7, 1986

[51] Int. Cl.[4] ..... E06B 7/16

[52] U.S. Cl. ..... 49/480; 49/485; 49/489

[58] Field of Search ..... 49/480, 489, 485, 475, 49/498

[56] References Cited

U.S. PATENT DOCUMENTS

| | | | |
|---|---|---|---|
| 2,077,845 | 4/1937 | Madsen | 49/489 |
| 2,293,292 | 8/1942 | Goellner | 49/489 |
| 2,918,710 | 12/1959 | Sitterly et al. | 49/489 |
| 3,140,517 | 7/1964 | Richter | 49/489 |
| 3,385,001 | 5/1968 | Bordner | 49/498 X |
| 3,448,543 | 6/1969 | Multer | 49/470 |
| 3,501,868 | 3/1970 | Ganzinotti | 49/477 |
| 3,521,404 | 7/1970 | Hager et al. | 49/489 X |
| 4,006,562 | 2/1977 | Belanger et al. | 49/489 X |
| 4,157,634 | 6/1979 | Coulston | 49/489 X |
| 4,658,548 | 4/1987 | Gerritsen | 49/489 X |

FOREIGN PATENT DOCUMENTS

| | | | |
|---|---|---|---|
| 22092 | 7/1956 | Fed. Rep. of Germany | 49/489 |
| 2312108 | 9/1973 | Fed. Rep. of Germany | 49/480 |
| 2459871 | 1/1981 | France | 49/489 |
| 1299 | of 1902 | United Kingdom | 49/480 |
| 1299735 | 12/1972 | United Kingdom | 49/480 |

*Primary Examiner*—Philip C. Kannan

*Attorney, Agent, or Firm*—Leo Gregory

[57] ABSTRACT

A weather strip construction for windows and doors having in combination leaf and compression dual durometer type sealing elements which co-act to accommodate sliding and meeting engagements of surfaces for effective weather sealing.

4 Claims, 10 Drawing Figures

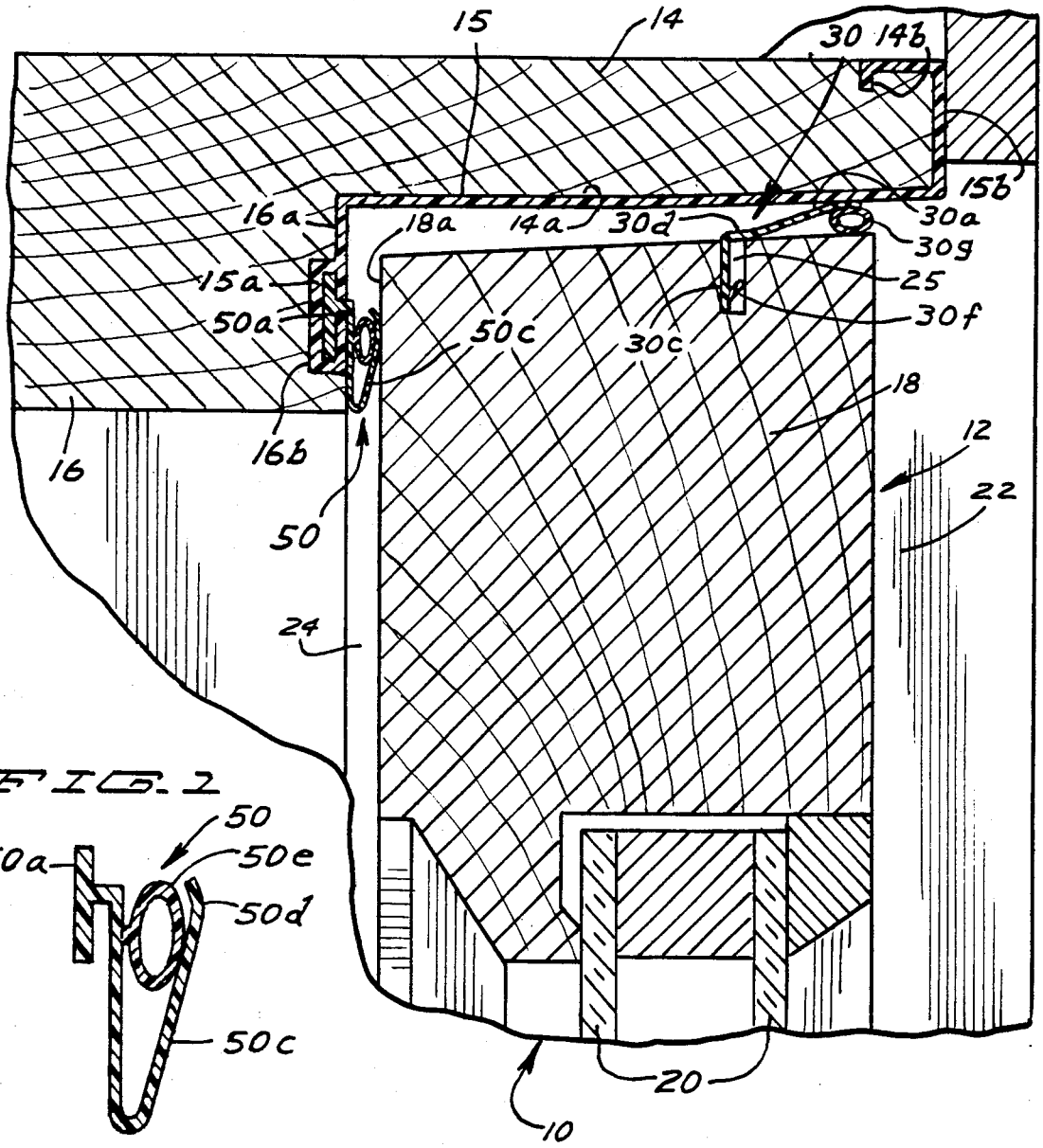
FIG. 1
FIG. 2
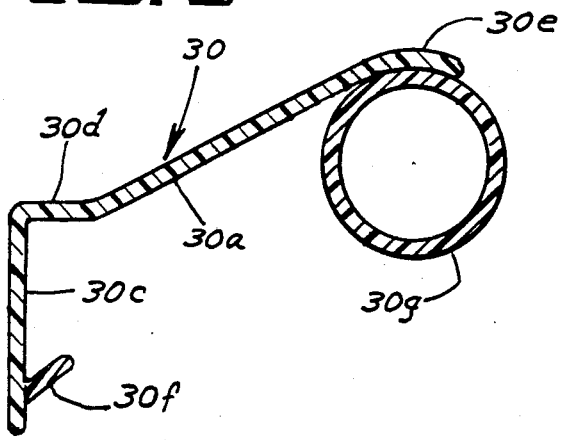
FIG. 3
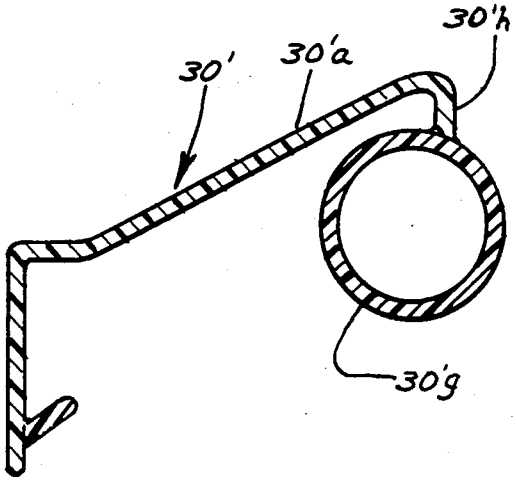
FIG. 4

EXTRUDED WEATHER STRIP STRUCTURE

BACKGROUND OF THE INVENTION

1. Field of Invention

This invention relates to weather sealing elements for windows and doors.

2. Description of the Prior Art

Typical prior art weather stripping has been in a roll form of a metal strip. With the development of hard plastic weather stripping material, it has become a common practice to copy the metal weather stripping as to form. For the most part, a leaf type of stripping is used as it has a low coefficient of friction and it nicely accommodates sliding surfaces. However, even this material tends to take a set and does not retain its original resilience and sealing effectiveness.

It is desirable to have integral compression means in connection with the hard plastic strip material such as by means of dual durometer extrusion to cause the strip material to maintain its original sealing effectiveness.

SUMMARY OF THE INVENTION

This invention relates to improvement in weather sealing structure.

It is desirable and an object of this invention to have in combination with a leaf type of weather stripping, a tubular or bulb type of compression element of elastomeric material to co-act with said seal weather stripping whereby through extended periods of use, the original configuration and sealing effectiveness will be maintained.

It is a further object of this invention to provide with a leaf type of weather stripping, a support bulb which resists compression set problems and thus causes the leaf type component to retain its original tight sealing engagement with adjacent window or door element surfaces.

It is also an object of this invention to provide a support leg of elastomeric material in lieu of a bulb type of element to cause the weather strip to maintain its original effective sealing.

These and other objects and advantages of the invention will be set forth in the following description made in connection with the accompanying drawings in which like reference characters refer to similar parts throughout the several views.

BRIEF DESCRIPTION OF THE DRAWINGS

FIG. 1 is a broken view in horizontal section of a casement window showing a preferred embodiment of the structure herein and a modification thereof in vertical longitudinal section in two operating positions; and FIGS. 2–10 are views in vertical longitudinal section showing significant modifications of the structure herein.

DESCRIPTION OF A PREFERRED EMBODIMENT

Figure 5:
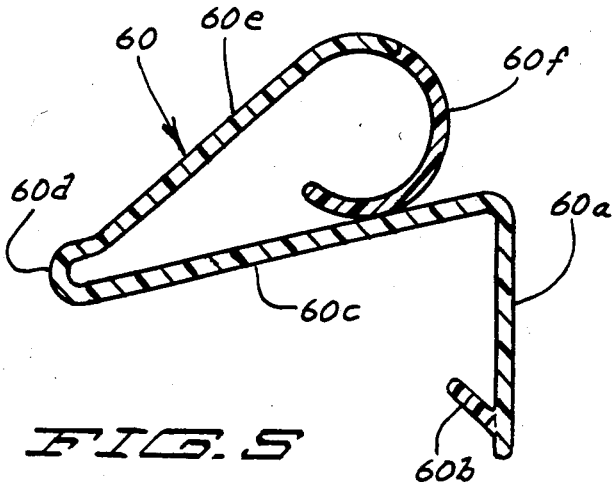

Referring to FIG. 1, a casement type of window 10 is indicated in which a casement window 12 is shown with a frame member of jamb strip 14 having milled integral therewith a stop strip or stop member 16.

Said jamb strip in the embodiment here illustrated is shown having its inner face 14*a* and the inner face 16*a* of the stop member 16 overlaid with a cladding strip 15 of a rigid material such as of a plastic or a metal. Said cladding strip is shown angled about the jamb strip at

15*b* to be secured at one end in the slot 14*b*. At its other end, formed therewith is a T-slot 15*a* disposed into the milled out recess 16*b* in said stop member 16.

Of said casement window 12, there is shown a vertical stile 18 in connection with a double pane 20. Said window swings outwardly through the front opening 22 and the rear or inside opening of said window is indicated at 24.

Extending through said stile 18 adjacent said jamb strip 14 is a slot 25 such as may be formed by a saw kerf and disposed into said slot is the leg or tail section 30*c* of a sealing member 30.

Said sealing member 30 is a preferred embodiment of the several forms of modifications thereof shown herein and these are all considered to be essential for an adequate disclosure of its generally used forms.

Said sealing member 30 as shown in FIG. 3 is a combination of leaf and bulb type of sealing member or strip. An arm portion 30*a* is angled upwardly such as on the order of 30° to 35°, the same being angled upwardly from a depending leg or tail portion 30*c*. At the upper end portion of the leg 30*c* is a right angled portion 30*d* from which the arm portion 30*a* angles upwardly.

Said arm portion has an arcuate tip portion 30*e* which has integral therewith and depending therefrom a bulb to tubular element 30*g*.

Except for its bulb or tubular form portion 30*g*, said sealing member 30 is formed of a hard plastic material. Hard plastic material has a low coefficient of friction and with the closing of the window slides easily on the adjacent surface of the jamb strip 14.

The leg portion 30*c* has adjacent its lower end an upwardly angled barb 30*f* which permits easy entry of said leg portion into said slot 25 but which effectively resists dislodgement from said slot. Said barb may be formed of an elastomeric material and is formed to be somewhat oversized to be under compression in said slot for good retention therein.

The tubular element 30*g* is formed of a suitable compressible or elastomeric material such as will retain its resilience for a long period of time.

As noted in FIG. 1, when the casement window is closed, the tubular element 30*g*, being under compression causes the leg portion 30*a* to have effective weather sealing engagement with the jamb strip 14. Said tubular member thus co-acts with said arm portion 30*a* to assure an effective sealing engagement with said jamb strip.

The combination of said leaf form of member 30 with the compression tubular and barb elements is the product of a dual durometer extrusion and such an extrusion provides unusual cost savings and convenience in forming the weather stripping.

Referring now to the stop member 16 in FIG. 1, the T-slot 40 therein faces the adjacent back wall 18*a* of said stile 18.

With respect to the stile 18, in closing onto the jamb strip 14, there is a sliding engagement between said arm 30*a* and the adjacent jamb strip 14. However, with regard to engagement with the stop member 16, there is not a sliding engagement but rather a direct head on meeting engagement and in connection therewith there is here described the weather strip member 50 of FIG. 2.

Said member has a T-projection 50*a* disposable into the T-slot 15*a*. Extending at right angles from said T-portion 50*a* is an angled depending arm 50*b* having an upwardly curved extending portion 50c which has an inwardly curved tip portion 50d.

Integral with said arm 50b is a tubular member 50e formed of an elastomeric compressible material which is form retaining. The remainder of said seal member 50 is formed of a resilient hard plastic material.

Extending at right angles from said T-portion 50a is an angled depending arm 50c and integral with the outer side thereof adjacent the upper end thereof is a tubular member 50d.

As illustrated in FIG. 1, the window 12 upon being closed causes the stile 18 to engage said arm portion 50c which bears against said tubular member 50d and this engagement is made under such pressure that the arm 50c is caused to have a weather sealing engagement with said stile. Here there is no relative sliding motion between the meeting bodies. This is a straight head on meeting engagement. It is essential that the tubular member 50d have such resilience as to retain its original form to avoid taking a set position which would diminish its sealing capability in connection with the arm portion 50c.

The various modifications will each be briefly described.

The structure 30' of FIG. 4 is substantially identical to the structure 30 with the difference that the tubular member 30'g thereof depends from the arm 30'a thereof by a neck portion 30'h.

The structure 60 of FIG. 5 has a leg portion 60a having a barb 60b in the manner of the leg member 30c and barb 30f and has an elongated arm 60c which is reversely curved at 60d to have an upwardly angled portion 60e terminating in an upwardly circularly curved end portion 60f formed of a suitable elastomeric material and being integral with said arm portion 60e in being extruded therewith. In being closed upon, the arm 60e yields and the circular or arcuate portion 60f yields but is formed of such a material as to retain its resilience indefinitely and bears against said arm 60e to provide a tight weather seal.

Figure 6:
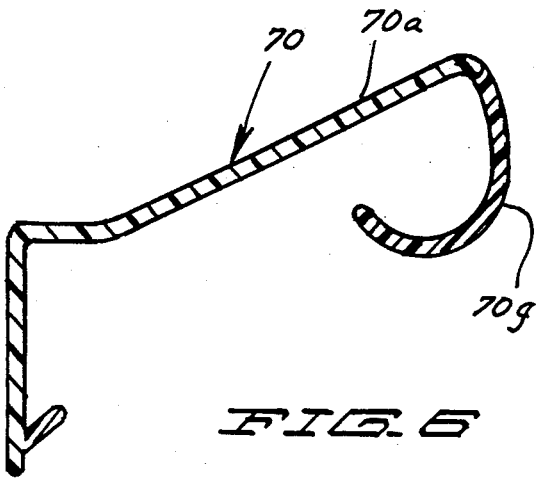

The structure 70 of FIG. 6, is almost identical to the structure 30 of FIG. 3 with the difference being that the arm 70a instead of having a tubular member integral therewith has a reversely curved end portion 70g extruded therewith and being formed of an elastomeric material having indefinite resilience to assure an effective weather seal in pressing against the arm 70a when closed upon.

Figure 7:
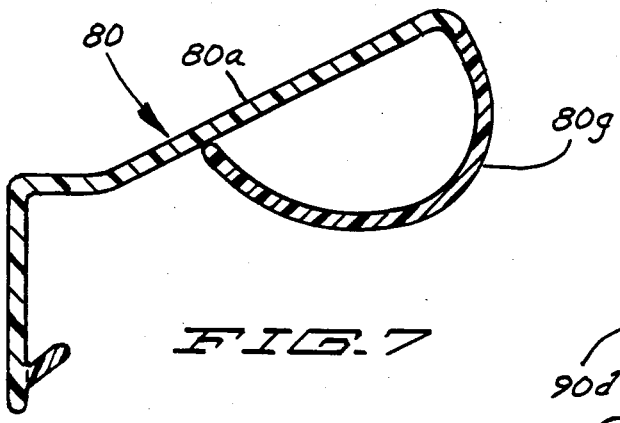

The structure 80 of FIG. 7 is substantially the same as that of FIG. 6 having for its difference the curved elastomeric extension 80g of its arm 80a forming a closed loop against the underside of said arm as contrasted to the open loop 70g of said structure 70.

Figure 8:
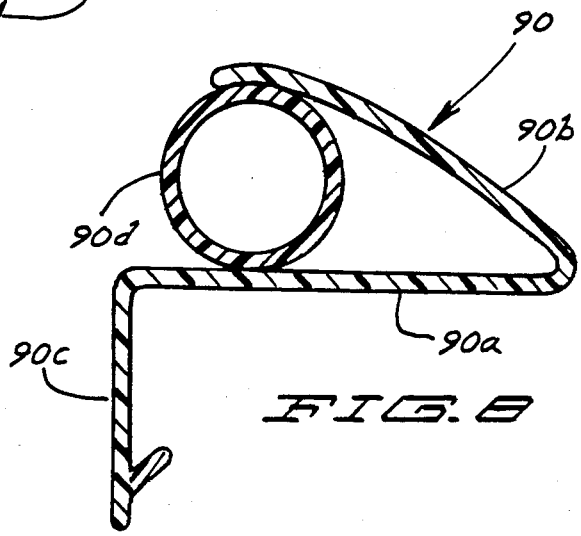

The structure 90 of FIG. 8 shows a structure having a barbed leg 90c as in the case of structure 30 of FIG. 3 and having an arm 90a at right angles thereto which has a reversely angled extension thereof as at 90b and disposed therebetween is a tubular member 90d. The angled arm 90b is formed of a hard relatively friction free plastic material for sliding engagement. The tubular member 90d assures tight sealing engagement of the arm 90b with an adjacent surface.

Figure 9:
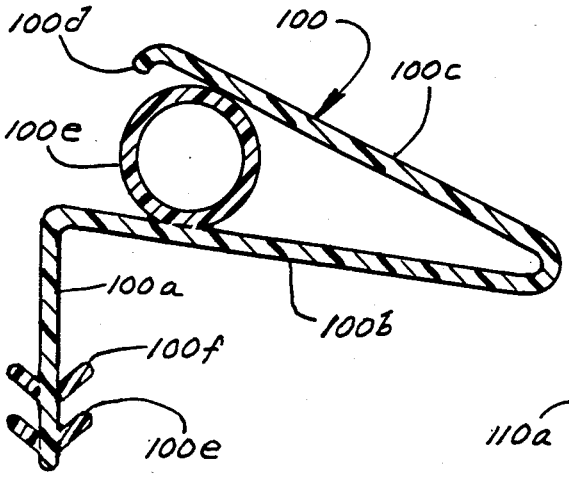

The structure 100 of FIG. 9 is substantially like that of FIG. 8 having a depending leg 100a and an arm 100b at right angles thereto which is reversely angled to have an upwardly angled portion 100c which has an inwardly curved tip portion 100d. Disposed between and adjacent the free ends of said arm portions is a compressible tubular member 100e of an elastomeric material which will bear against the arm portion 100c to maintain it in a weather sealing engagement with an adjacent door or window frame member.

Said depending leg 100a is shown having pairs of barbs 100e and 100f.

Figure 10:
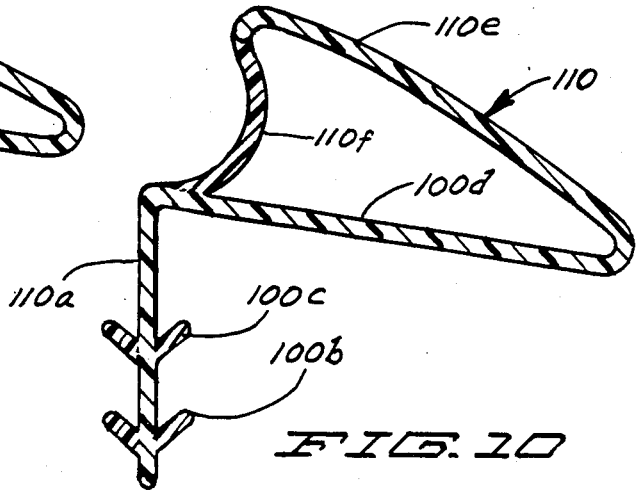

Referring to FIG. 10, a structure 110 is shown in which the leg 100a thereof has a double pair of barbs 100b and 110c like that of the structure of FIG. 9. Angled from said leg 110a is an arm 100d which has a reversely curved upwardly angled arm portion 110e.

A reversely curved end portion 110f connects the free end of the arm 110e and the leg 110a at its juncture with the arm 110d.

Said leg 110a and arms 110d and 110e are formed of a hard plastic material, the barbs and said curved end portion 110f are formed of an elastomeric material having a long enduring resilience. Said end portion 110f yields to pressure and does not assume a set position. The resilience of said end portion causes the arm 110e to bear against an adjacent frame member in an effective weather seal engagement.

OPERATION

In operation, the various modifications shown all function in a like manner.

It is desirable to have the parts which have a sliding engagement with adjacent window and door frame members to be made of a relatively friction free hard plastic material. In time this material is known to lose some resilience, take a set, and become less effective as a weather seal. These are the parts such as the arm 30a of the structure of FIGS. 1 and 3.

To prevent the hard plastic parts such as the arm 30a from becoming set in position, extruded therewith are elastomeric or rubberlike tubular or curved members such as 30g which are extruded with the hard plastic portions to provide dual durometer elements co-acting whereby the tubular or curved members designed to have a long use period or resilience are caused by the closing of a window or door, as the case may be, to bear against the hard plastic portions of the sealing member to make an effective weather seal with an engaging window or door frame member.

The drawings together with the descriptions above given are believed to make clear the useful application of each of the forms of the invention shown.

It will of course be understood that various changes may be made in the form, details, arrangement and proportions of the product without departing from the scope of the invention which, generally stated, consists in a product capable of carrying out the objects above set forth, such as disclosed and defined in the appended claims.

What is claimed is:

1. An elongated weather strip structure, as for a casement window, having in combination a body member of a hard resilient material, a leg portion of said body member adapted to be inserted into a slot in a frame member of said window, means retaining said leg portion in said slot, an arm portion of said body member angled oppositely of said leg portion and forming an acute angle with said body member, and a member of form retaining compressible material integral with an adjacent free end portion of said arm disposed between said arm portion and said body member and co-acting therewith in forming a weather seal.

2. The structure of claim 1, wherein said form retaining member is tubular.

3. The structure of claim 1, wherein said form retaining member is tubular and is disposed at the side of said body portion remote from said leg portion.

4. The structure of claim 1, wherein said means consists of at least one barb.

* * * * *